US006529695B2

(12) United States Patent
Katayanagi et al.

(10) Patent No.: US 6,529,695 B2
(45) Date of Patent: Mar. 4, 2003

(54) IMAGE-FORMING APPARATUS

(75) Inventors: Hidetoshi Katayanagi, Tokyo (JP); Shigetaka Kurosu, Tokyo (JP); Masashi Saito, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/970,511

(22) Filed: Oct. 4, 2001

(65) Prior Publication Data

US 2002/0044787 A1 Apr. 18, 2002

(30) Foreign Application Priority Data

Oct. 12, 2000 (JP) ..... 2000-311870

(51) Int. Cl.[7] ..... G03G 15/16
(52) U.S. Cl. ..... 399/49; 399/66; 399/302
(58) Field of Search ..... 399/49, 66, 299, 399/302, 317, 318

(56) References Cited

U.S. PATENT DOCUMENTS 6,167,215 A * 12/2000 Miyashiro et al. ..... 399/302
6,167,230 A * 12/2000 Kimura et al. ..... 399/315

FOREIGN PATENT DOCUMENTS

JP 06-003913 * 1/1994
JP 11-258878 * 9/1999

* cited by examiner

*Primary Examiner*—Sophia S. Chen
(74) *Attorney, Agent, or Firm*—Frishauf, Holtz, Goodman & Chick, P.C.

(57) ABSTRACT

An image forming apparatus is provided which includes photoreceptors, around which are a charging section, an exposing section and a developing section, for forming a toner image. The image forming apparatus also includes a rotatable intermediate transfer member, first transfer sections, a second transfer section, having a transfer roller, for transferring the toner image from the intermediate transfer member to a transfer material, and a controller to control the image forming condition based on a detected density of an image pattern a formed on a non-image area of the photoreceptor. The controller releases a pressure contact of the transfer roller of the second transfer section, before the image pattern α arrives at the second transfer section and starts a next print cycle after again making the pressure contact.

4 Claims, 3 Drawing Sheets

IMAGE-FORMING APPARATUS

BACKGROUND OF THE INVENTION

The present invention relates to an image-forming apparatus having a control means, wherein there is a function that makes a proper image, by forming image pattern α for the detection of an image density in a non-image area, and by correcting image density and gradation of an image area, by performing feed-back of its detected density, and image-forming is made to be efficient. Incidentally, the image pattern α means a flat density pattern that is formed in a non-image area located between the regular image area and the next following regular image area, and is used for detection of image density which serves to make the quality of the regular image to be appropriate.

There is an image-forming apparatus wherein a toner image is formed on an image carrier having a charging means, an exposure means and a developing means around the image carrier, then, the toner image is transferred on an intermediate transferring member (primary transfer), and the toner image is transferred electrostatically from the intermediate transferring member to a recording medium such as a transfer sheet by a transfer roller (secondary transfer). Moreover, there is known one wherein, for correcting image density and gradation, image-related parameter is corrected and an image is made to be appropriate by making image pattern α on a non-image area on the image carrier, and by providing a sensor for detecting the image pattern α on the intermediate transferring member.

In the past, as shown in TOKUKAIHEI No. 9-204108, the above-mentioned sensor is provided at a position that is between a downstream side of a primary transfer position and an upstream side of a secondary transfer position, on the intermediate transfer member, however, as it is necessary to secure the distance between the first transfer and the secondary transfer to a certain extent or more, it disturbs the miniaturization of the apparatus and the reduction of first-print-out time.

On the other hand, when the above-mentioned sensor is provided on the downstream side of the secondary transfer, it is necessary to apply bias voltage of the same polarity with that of toner on the secondary transfer roller, when the image pattern α passes through the position of the secondary transfer roller so that the above-mentioned image pattern α may not transfer to the secondary transfer roller as mentioned in TOKUKAIHEI No. 7-253729. In this case, it is thought that the back side of the transfer sheet is soiled by a soiled surface of the secondary transfer roller, and it is also thought that the density cannot be detected correctly because of disturbance of the image pattern α, since an amount of toner moving to the secondary transfer roller is not zero, and the transferring amount varies depending upon environment.

To solve these problems, it is thought to let the secondary transfer roller be away from the intermediate transfer member, when the image pattern passes through the secondary transfer position, however, if it is intended to make the above-mentioned pattern α between images in the course of the continuous printing, the image is influenced by the uneven rotation of the intermediate transfer member, when the secondary transfer roller is pressed or released. As a means to prevent disturbance of the image pattern α, it is thought to constitute the secondary transfer section with the non-contact transfer means such as corotron, which, however, has demerits that an ozone generating amount is increased and sheet transfer characteristics is worsened.

SUMMARY OF THE INVENTION

An object of the present invention is to provide an image-forming apparatus wherein a means for raising the print productivity and an image correcting means for improving image quality are provided, and considering the furnishing position of the sensor, bad influence is not given to the image, when the secondary transfer roller is released from or pressed on the intermediate transfer member while the image pattern α passes through the secondary transfer position, and the position of the density detection sensor to be set is considered, and less hazardous material such as ozone is emitted.

The object stated above is attained by the technical means (1) shown below.

(1) An image-forming apparatus, in which a plurality of image carrier units each having charging, exposing and developing means around itself are provided, a toner image is formed on the above-mentioned each image carrier, each toner image is superposed to be primarily transferred onto the intermediate transfer member by the transfer roller, and then, toner images are secondarily transferred collectively from the intermediate transfer member to the transfer material by the transfer roller, while, image pattern α is formed on a non-image area on the image carrier, then, is primarily transferred onto the intermediate transfer member, and its image density is detected by the image pattern α detecting sensor provided at the downstream side of the secondary transfer position in the running direction of the intermediate transfer member to face the surface of the intermediate transfer member, and there is provided a control means that conducts process control by changing image-forming conditions with the detected value of the above-mentioned detecting sensor, wherein the control means controls so that the latent-image formation of the following print image may start, after the pressure contact of the secondary transfer roller to the intermediate transfer member is released, when image pattern α has passed through the first transfer position of its final color to the direction of the downstream side of the rotation direction of the above-mentioned intermediate transfer member, and after the secondary transfer of image which is formed before the formation of the image pattern α is completed before the arrival of the image pattern α at the secondary transfer position, and after the pressure contact of the secondary transfer roller to the intermediate transfer member is applied again, immediately after the image pattern α passes through the secondary transfer position.

That is, before the image pattern α reaches the secondary transfer position after having passed through the first transfer position, and immediately after the secondary transfer of the image formed before the formation of the image pattern α was completed, the secondary transfer roller is released from pressure contact, and immediately after the image pattern α passed through the secondary transfer position, the secondary transfer roller is subjected to pressure contact again, and after that, the next image formation is performed. Due to this, it is possible to miniaturize the apparatus and to raise the productivity of prints as far as possible, using the contact type secondary transfer method in which ozone emission amount is low, under the condition that both of an image and image pattern α in the non image area are not disturbed.

DETAILED DESCRIPTION OF THE PREFERRED EMBODIMENT

Figure 1:
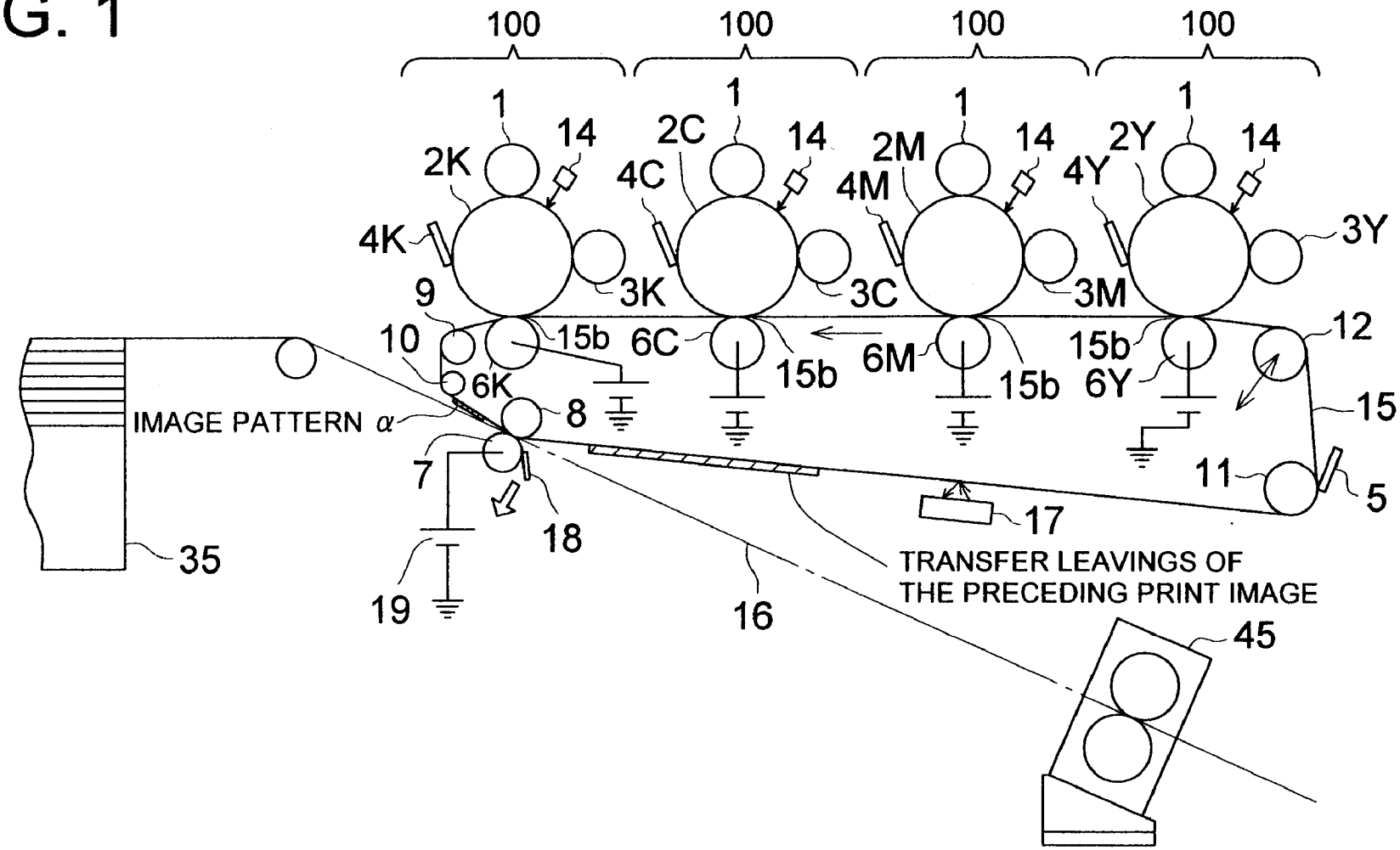
FIG. 1 is a schematic construction drawing showing the condition just before releasing pressure contact of a secondary transfer roller in an embodiment of an image-forming apparatus of the invention.

Preferred embodiments of the present invention will be described in detail below, referring to the drawings. Descriptions below are not to be construed to limit the technical scope of the invention and the definition of terms.

FIG. 1 is a schematic diagram of a color image-forming apparatus which relates to the present invention, and especially of an image-forming apparatus wherein an intermediate transfer belt is placed horizontally in a longitudinal direction so that monochrome and full-color images can be formed.

This embodiment comprises plural sets (i.e. four sets in this embodiment) of image-forming units 100, for each color, each at least comprising a photoreceptor 2 used an image-forming body or an image carrier, an charging roller 1 used as charging means, an exposing optical system 14 used an image writing means, and a developing device 3 (3Y, 3M, 3C and 3K) used as a developing means. In the embodiment, each image-forming unit 100 of yellow (Y), magenta (Y), cyan (C) and black (B) is placed beginning from the right in the following order: Y, M, C, K oppositely facing the horizontal stretching surface of an intermediate transfer belt 15 which travels in a loop. Four sets of image-forming units 100 for four colors have the same structure.

The charging roller 1 electrifies photoreceptor 2 with an electric charge which has the same polarity as the toner (i.e. negative charging in this embodiment), at each given potential in order to apply a uniform electric potential to the photoreceptor 2.

The exposing optical system 14 is placed on the downstream side of the charging roller 1 in the rotation direction of the photoreceptor 2 and is also located on the upstream side of the developing device 3.

The exposing optical system 14 is an exposing unit consisting of exposing elements arrayed in the scanning direction in parallel to the rotating shaft of the photoreceptor 2, for example, an array of plural LEDs (Light Emitting Diodes), and a light convergent light transmitting body (product name: Selfoc Lens Array) used as an image-forming element. A laser optical system can be applied to the exposing optical system 14. The exposing optical system 14 exposes an image on the photoreceptive layer of the photoreceptor 2 according to each color's image data which has been read by an image reading device installed separately and recorded in the memory, and then forms an electrostatic latent image of each color.

In the photoreceptor 2 (2Y, 2M, 2C, 2K), photoreceptive layer of the charge generation layer (lower layer) and the charge transporting layer (upper layer) are laminated in the described order or reverse order on the under-coating layer formed on the surface of a conductive cylindrical supporting body. A publicly known surface protecting layer, for example, an over-coating layer mainly made of thermoplastic or thermosetting polymer, may be formed on the surface of the charge transporting layer or the charge generating layer. In this embodiment, the conductive cylindrical supporting body of the photoreceptor 2 is grounded.

The developing device 3 (3Y, 3M, 3C, 3K) has a cylindrical non-magnetic stainless steel or aluminum developing sleeve (not shown) which maintains given clearance between the peripheral surface of the photoreceptor 2 and rotates in the same direction as that of the photoreceptor 2.

The developing sleeve contains a one- or two-component developer which includes yellow (Y), magenta (M), cyan (C) and black (B) according to each developing color (i.e. toner is negatively charged in this embodiment) In this embodiment, a two-component developer is contained. The sleeve of the developing device 3 does not come in contact with the drum surface of the photoreceptor 2 maintaining given clearance, for example, 100 to 500 $\mu$m by means of a thrust roller (not shown) or the like. A toner image is formed on the drum of the photoreceptor 2 by impressing the developing bias which superimposes the direct current voltage and the alternative current voltage on the developing sleeve thereby performing the contact or non-contact reversible development.

An intermediate transfer member (i.e. intermediate transfer belt) 15 is tightly stretched being circumscribed by an intermediate transfer belt drive roller 11, intermediate transfer belt tension roller 12, intermediate transfer belt supporting rollers 9 and 10 and a secondary transfer backup roller 8 so that the intermediate transfer member (i.e. intermediate transfer belt) 15 rotates in the counterclockwise direction. Further, a secondary transfer roller 7 oppositely faces a secondary transfer backup roller 8 via the intermediate transfer member (i.e. intermediate transfer belt) 15. Further cleaning blade 5 abuts on the intermediate transfer member (intermediate transfer belt) 15 located at the position of drive roller 11, a cleaning blade 18 abuts on the secondary transfer roller 7, and each cleaning blade 4Y, 4M, 4C, 4K abuts on each respective photoreceptor 2 which carries an image, in the counter-clockwise direction, respectively. Furthermore, similarly, each primary transfer roller 6 (6Y, 6M, 6C, 6K) for each color oppositely faces each photoreceptor via the intermediate transfer member (i.e. intermediate transfer belt) 15 at nip 15*b*.

The intermediate transfer member (i.e. intermediate transfer belt) is an endless belt with a volume resistance of $10^6$ to $10^{12}$ Ωcm. For example, intermediate transfer belt uses resin material, such as polycarbonate (PC), polyimide (PI), polyamide imide (PAI), polyvinylidene fluoride (PVDF), tetrafluoroethylene-ethylene copolymer (ETFE), etc., or rubber material such as EPDM, NBR, CR and polyurethane, etc., which mixes conductive filler, such as carbon, etc., or contains ionic conducting material. The preferable thickness is approximately 50 to 200 $\mu$m for resin material and 300 to 700 $\mu$m for rubber material. There is a case where a rubber layer is formed on a resin belt, or a coating layer is further formed on the surface layer.

The intermediate transfer member (i.e. intermediate transfer belt) 15 is driven by the rotation of a drive roller 11 which is driven by a drive motor (not shown).

For example, the drive roller 11 is usually made of the material which coats the peripheral surface of a conductive cored bar (no reference numeral assigned), such as stainless steel, etc., with conductive or semi-conductive material (no reference numeral assigned) which mixes rubber or resin material, such as polyurethane, EPDM, silicon, etc., with conductive filler, such as carbon, etc.

The first transfer roller 6 oppositely faces the photoreceptor 2 via the intermediate transfer member (i.e. intermediate transfer belt) 15 thereby forming a transfer area 15*b* between the intermediate transfer member (i.e. intermediate transfer belt) 15 and the photoreceptor 2.

A direct current voltage which has an opposite polarity of the toner (i.e. positive polarity in this embodiment) is applied to the first transfer roller 6 to form an electric field in the transfer area. This makes it possible to transfer toner images of each color which have been formed on the photoreceptor 2 onto the intermediate transfer member (i.e. intermediate transfer belt) 15.

The first transfer roller 6 for each color, which is primary transfer means, is made, for example, by coating the peripheral surface of a conductive cored bar, such as stainless steel, etc., having an outer-diameter of 8 mm (not shown) with semi-conductive elastic rubber (not shown). The semi-conductive elastic rubber, which mixes rubber material, such as polyurethane, EPDM, silicon etc. with conductive filler, such as carbon, etc. or contains ionic conducting material, is solid or formed sponge having a volume resistance of $10^5$ to $10^9$ Ωcm, a thickness of 5 mm, a rubber hardness (Asker-C) of approximately 20 to 700.

The secondary transfer roller 7 for transferring images onto the surface of the transfer material oppositely faces the secondary transfer backup roller 8 which comes in contact with the secondary transfer roller 7 via the intermediate transfer member (intermediate transfer belt) 15. A direct current voltage which has an opposite polarity of the toner (i.e. positive in this embodiment) is applied to the secondary transfer roller 7 by a direct current power source 19 (not shown) in order to transfer the superimposed toner image carried on the intermediate transfer member (intermediate transfer belt) 15 onto the surface of the transfer material.

The secondary transfer roller 7, which is the secondary transfer means for retransferring color toner image on the intermediate transfer member (intermediate transfer belt) 15 onto recording material is made, for example, by coating the peripheral surface of a conductive cored bar, such as stainless steel, etc., having an outer-diameter of 16 mm (not shown) with semi-conductive elastic rubber (not shown). The semi-conductive elastic rubber, which mixes rubber material, such as polyurethane, EPDM, silicon etc. with conductive filler, such as carbon, etc. or contains ionic conducting material, is solid or foamed sponge having a volume resistance of approximately $10^5$ to $10^9$ Ωcm, a thickness of 7 mm, a rubber hardness (Asker-C) of approximately 20 to 70°. Different from the first transfer roller 6, there is a case where the surface of the secondary transfer roller 7 is coated with semi-conductive fluorocarbon resin or urethane resin, etc. which has a good mold-releasing property because the secondary transfer roller 7 comes in direct contact with the toner. The secondary transfer backup roller 8 is made by coating the peripheral surface of a conductive cored bar (not shown), such as stainless steel, etc., with semi-conductive material which mixes rubber or resin material, such as polyurethane, EPDM, silicon etc., with conductive filler such as carbon, etc., or contains ionic conducting material, forming the coated layer to be approximately 0.05 to 0.5 mm.

The cleaning blade 4 or 5 is made by bonding a urethane rubber sheet that has a thickness of 1 to 3 mm and a JIS-A hardness of 60 to 80° onto the sheet metal holder so that free length becomes approximately 5 to 12 mm. The load of the cleaning blade is approximately 5 to 50 gf and the blade abuts on the photoreceptor 2 and the intermediate transfer belt 15. In some case, the blade tip is coated with fluorine to prevent the blade from turning up or a conductive urethane rubber is used for the blade to prevent the opposing side from being charged.

Transfer material, such as recording paper, etc., is sent out one by one from a schematically shown integrating device 35, carried overlapping by the intermediate transfer belt 15 which is sandwiched between the secondary transfer roller 7 and the secondary transfer backup roller 8, receives secondary transfer of the toner image, and is sent to a fixing unit 45 along a paper path 16, and is then fixed by thermal bonding and finally collected.

Incidentally, it is preferable from the view point of controlling the emission of the harmful ozone that charging roller 1 is used as a means for charging the photoreceptor 2, and the first transfer roller 6 is used as the first transfer member, but, it is also possible to use a colotron electric discharging device as a charging means of the non-contact condition, without being limited to the foregoing.

After the toner image on the photoreceptor 2 is transferred to the intermediate transfer member (i.e. intermediate transfer belt). 15 as the first transfer, the toner image is transferred from the intermediate transfer member (i.e. intermediate transfer belt) 15 to transfer paper by the transfer roller 7 as the secondary transfer. The detecting sensor 17 of image pattern α provided to face the surface of the intermediate transfer member is provided at the downstream side of the secondary transfer position in the rotating direction of the intermediate transfer member (i.e. intermediate transfer belt) 15. The process control is performed by the control means representing CPU so that the proper image may be obtained by changing the image-forming condition of the next image by using the detected information. Further the control means controls the establishment of the timing of pressure contact and releasing of the secondary transfer roller 7 so that the copy productivity is secured to be effective while preventing an adverse effect on the image quality.

Figure 3:
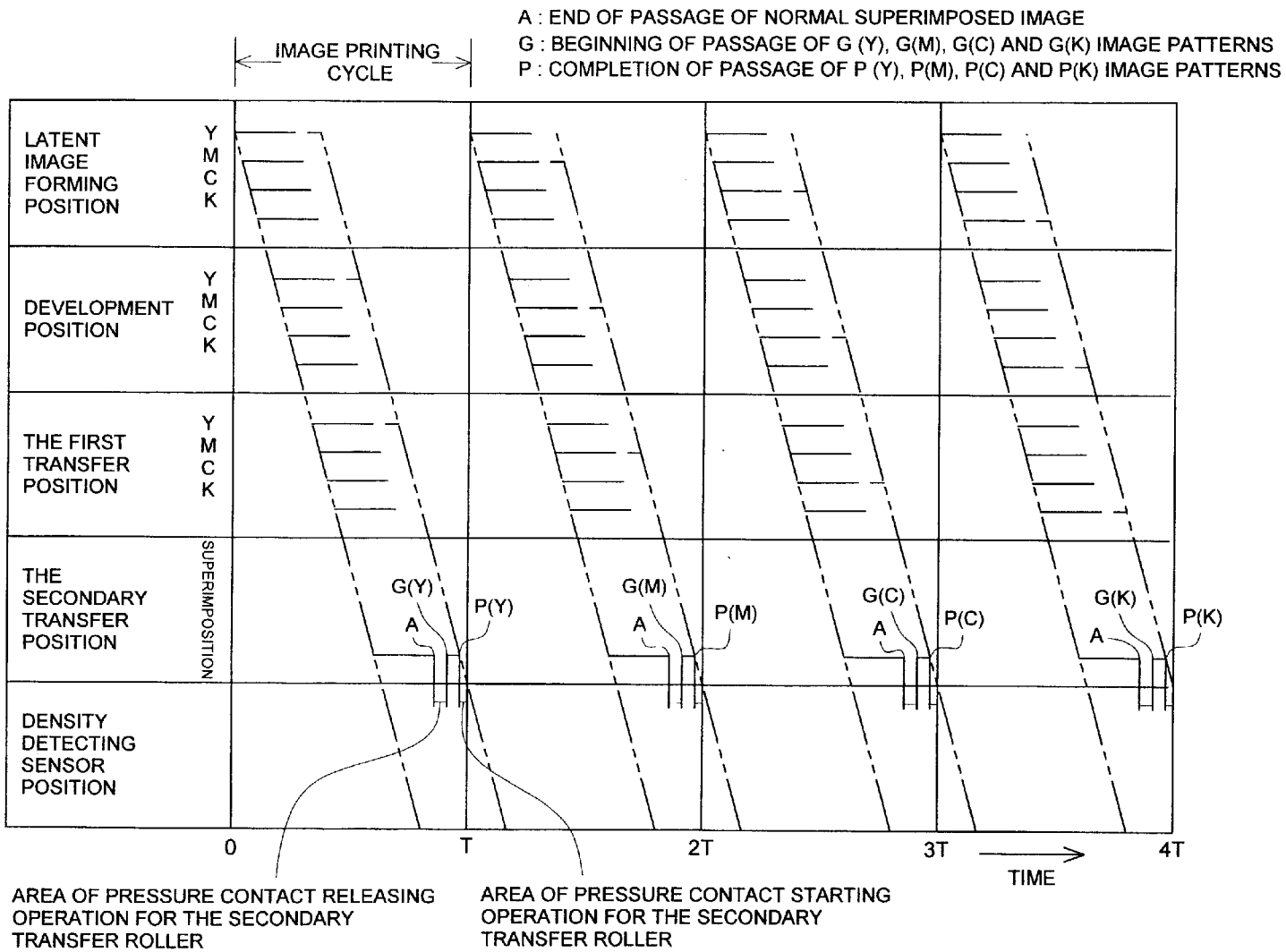
FIG. 3 is an example of a time chart of an operation conducted by a control means of an image-forming apparatus of the invention.

The above-mentioned control will be shown by a timing chart in FIG. 3.

That is, the latent images of the image and the image pattern α for each of Y, M, C and K are formed by each of the image-forming unit 100.

Figure 2:
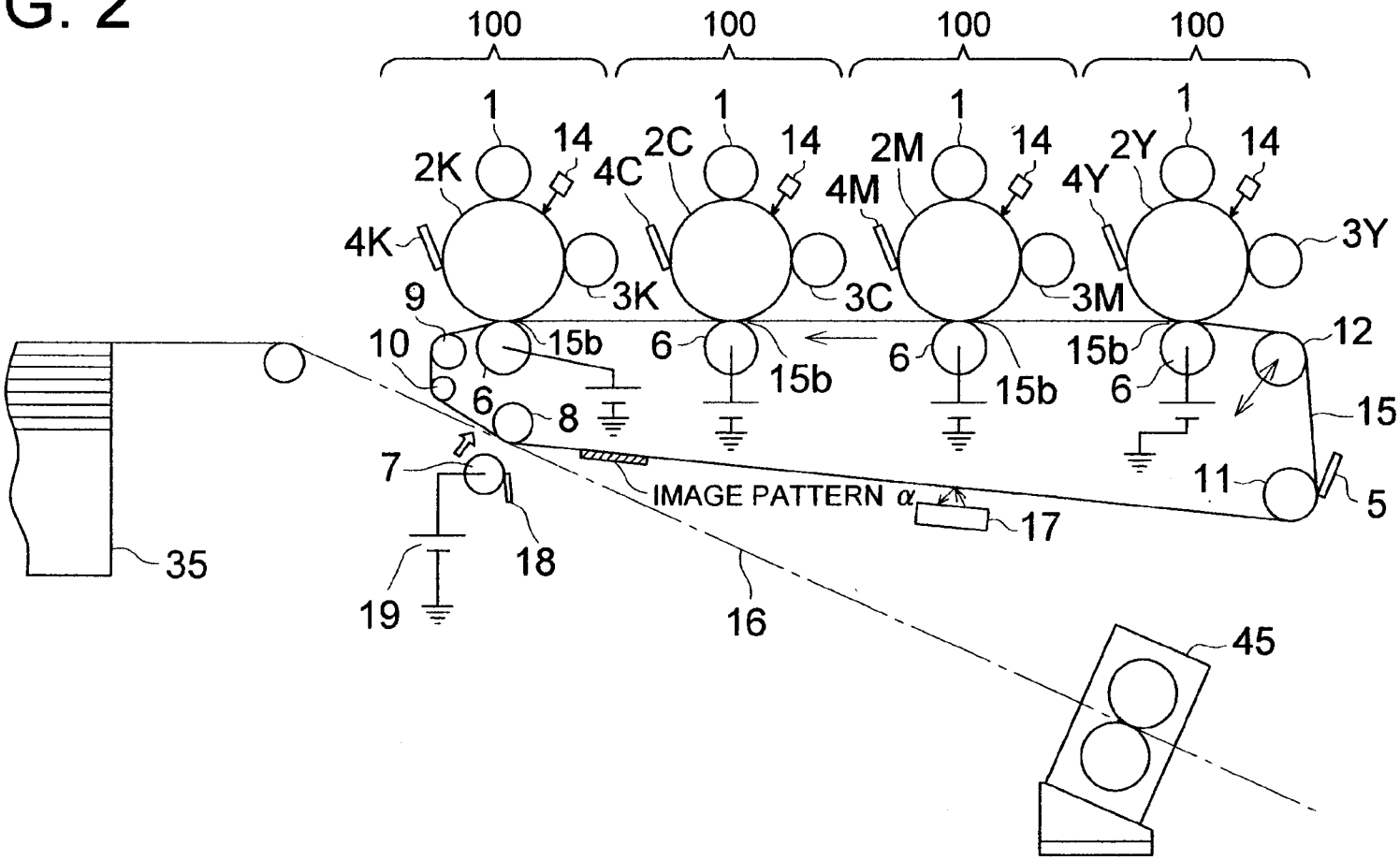
FIG. 2 is a schematic construction drawing showing the condition just before pressure contact of a secondary transfer roller in an embodiment of an image-forming apparatus of the invention.

The latent images pass through the developing position and the first transfer position successively, and the superimposed image completes passing the position of the secondary transfer roller 7 and reaches point A shown in the timing chart of FIG. 3. Then the secondary transfer roller 7 leaves intermediate transfer belt 15 as shown by a thick arrow in FIG. 1, and the image pattern α of either one of Y, M, C and K starts passing through the secondary transfer position at the timing point G that is delayed slightly from point A, and, passes completely at the timing point P. Slightly later than this, as shown by a thick arrow in FIG. 2, the secondary transfer roller 7 starts pressing the backup roller 8 again via the intermediate transfer member (intermediate transfer belt) 15, and after the pressing has been stabled, the next latent image-forming cycle starts, to repeat this copying cycle.

Since the secondary transfer roller 7 of the contact type is used as the secondary transfer means in this invention, as mentioned above, it is possible to control the emission of ozone to be less than that in case of using a corotron of a discharging mode, and the transportability for the transfer material is also desirable, however, there is a problem that the vibration caused when the secondary transfer roller 7 is pressed against and released from the intermediate transfer member (transfer belt) 15 gives bad influence to an image.

Therefore, the timing of pressing against and releasing from the intermediate transfer member was selected to the time when the harmful influence such as the disturbance to the image did not happen. Under the scope of the limitation, the cycling time for the continuous printing is set to be short as far as possible to be effective, and by providing the detecting sensor 17 on a large space after the position of the secondary transfer, the first print-out time is set to be short, by shortening the distance from the first transfer position to the secondary transfer position.

Incidentally, the image pattern α is formed once in the aforesaid each cycle, by selecting one color from Y, M, C and K, and its image density is detected and is reflected for the image formation. Further, color balance and gradation of the obtained image become proper together with density. The above-mentioned operation that the image pattern α is formed and its image is detected to be reflected for the image formation is not always necessary for each copy (print). In case of not using this operation, the speed of the continuous copying (printing) increases, because the following printing cycle can be started in parallel with the preceding printing cycle, before the preceding printing cycle is completed. It is preferable that the image pattern α is formed every ten to five hundred copies. Due to this, it is possible to adjust the image and to decrease the toner amount consumed for making the image pattern α without reducing the continuous copying speed.

Before the image pattern α reaches the secondary transfer position after having passed through the first transfer position, and immediately after the secondary transfer of the image formed before the formation of the image pattern α is completed, the secondary transfer roller is released from pressure contact, and immediately after the image pattern α following the image area has passed through the secondary transfer position, the secondary transfer roller is subjected to pressure contact, and after that, the next image formation is performed. Due to this, it has become possible to provide an image-forming apparatus which can improve the productivity of print as far as possible, without disturbing an image and image pattern α on the non-image area, while using the contact type secondary transfer method that emits less amount of ozone.

What is claimed is:

1. An image forming apparatus comprising:

a plurality of photoreceptors, around each of which is provided a charging section, an exposing section and a developing section, so that a toner image is formed on each of the plurality of photoreceptors;

a rotatable intermediate transfer member;

first transfer sections, each of which has a transfer roller, for transferring the toner image from each of the plurality of photoreceptors to the rotatable intermediate transfer member so that a superimposed toner image is formed on the rotatable intermediate transfer member;

a second transfer section, having a transfer roller for transferring the superimposed toner image from the intermediate transfer member to a transfer material; and a controller for controlling a process of the image forming apparatus by forming an image pattern α on a non-image area of each of the plurality of photoreceptors, transferring the image pattern α onto the intermediate transfer member, detecting a density of the image pattern α on the intermediate transfer member at a position downstream from the second transfer section, and adjusting an image forming condition based on a detected density of the image pattern α;

wherein the controller releases a pressure contact of the transfer roller of the second transfer section from the intermediate transfer member after the image pattern α has passed the first transfer sections, after the superimposed toner image formed before the image pattern α has been transferred by the second transfer section, and before the image pattern α arrives at the second transfer section, and wherein the controller brings the transfer roller of the second transfer section in contact with the intermediate transfer member after the image pattern α has passed the second transfer section, and starts a latent image formation of a next print cycle.

2. The image forming apparatus of claim 1, wherein the apparatus forms a cyan toner image pattern α, a magenta toner image pattern α, a yellow toner image pattern α and a black toner image pattern α.

3. The image forming apparatus of claim 1, wherein the rotatable intermediate transfer member comprises a belt.

4. The image forming apparatus of claim 1, wherein the image pattern α is formed for every 10 to 500 print cycles.

* * * * *